United States Patent [19]

Gallagher

[11] 3,947,029

[45] Mar. 30, 1976

[54] LOW DENSITY CAST RACQUET

[75] Inventor: Peter Christopher John Gallagher, Hightstown, N.J.

[73] Assignee: N L Industries, Inc., New York, N.Y.

[22] Filed: May 31, 1974

[21] Appl. No.: 475,166

[52] U.S. Cl. ..... 273/73 D; 273/73 H; 164/112

[51] Int. Cl.[2] ..... A63B 51/00; A63B 49/12

[58] Field of Search .... 273/73 R, 73 C, 73 D, 73 F, 273/73 H, 73 J, 73 K, 82 A

[56] References Cited

UNITED STATES PATENTS

| | | | |
|---|---|---|---|
| 1,186,283 | 6/1916 | Coddington | 273/73 H |
| 1,520,106 | 12/1924 | Bishop et al. | 273/82 A |
| 1,548,134 | 8/1925 | Gallaudet | 273/73 H |
| 1,954,327 | 4/1934 | Panker | 273/73 D |
| 2,064,435 | 12/1936 | Loeffler | 273/82 A UX |
| 3,582,073 | 6/1971 | Melnick et al. | 273/73 D |
| 3,612,526 | 10/1971 | Brull | 273/73 C |
| 3,647,211 | 3/1972 | Doessel et al. | 273/73 D X |
| 3,664,669 | 5/1972 | Latham et al. | 273/73 H X |
| 3,702,701 | 11/1972 | Vaughn et al. | 273/73 H |
| 3,815,660 | 6/1974 | Gallagher et al. | 273/73 D X |

FOREIGN PATENTS OR APPLICATIONS

| | | | |
|---|---|---|---|
| 185,275 | 9/1922 | United Kingdom | 273/73 H |
| 16,414 | 9/1891 | United Kingdom | 273/73 D |
| 1,126,438 | 9/1968 | United Kingdom | 273/73 C |
| 798,744 | 11/1968 | Canada | 273/73 H |
| 2,033,630 | 11/1970 | France | 273/73 F |
| 227,012 | 1/1925 | United Kingdom | 273/73 D |
| 1,099,400 | 1/1968 | United Kingdom | 273/73 H |

*Primary Examiner*—Richard J. Apley

[57] ABSTRACT

A one-piece, cast racquet of material having density not above about 3.0 grams per cubic centimeter comprises a handle and a head-portion, the latter having integral stringing means characterized by a wrought metal member bonded in the cast head portion of the racquet; and method for making same wherein the wrought metal member is assembled in the head-portion of a die set and the resulting die cavity filled with the low density material thereby forming the cast handle and head-portion of the racquet and simultaneously bonding the wrought metal stringing member therein. The term "cast" will be understood to include metal die-casting and plastic pressure moulding operations.

11 Claims, 9 Drawing Figures

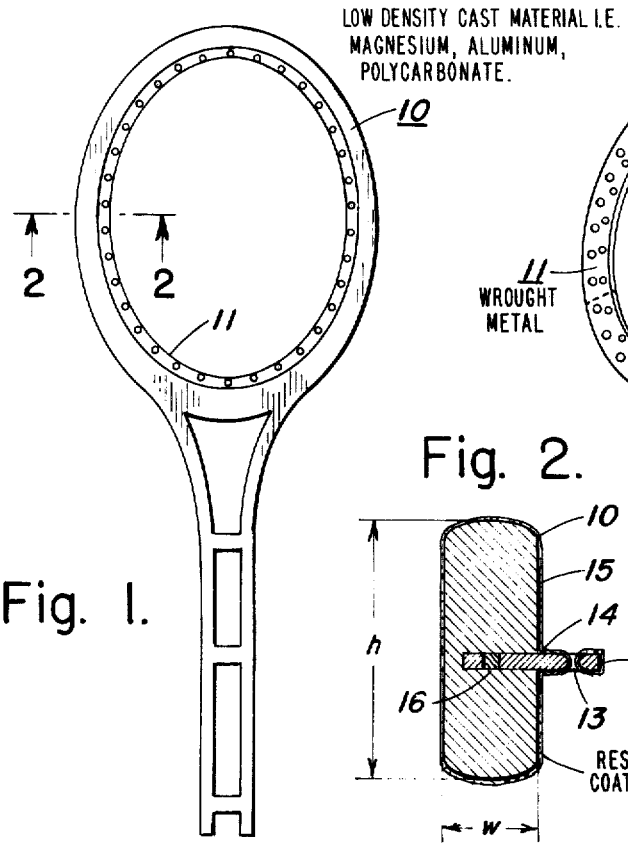
Fig. 1.
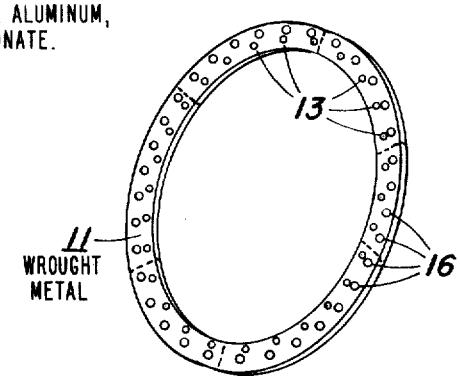
Fig. 3.
Fig. 2.
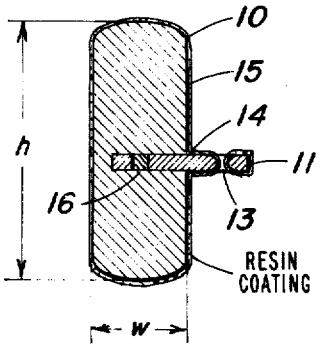
Fig. 9.
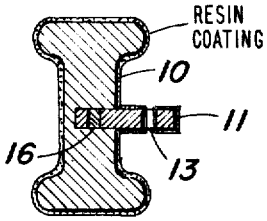
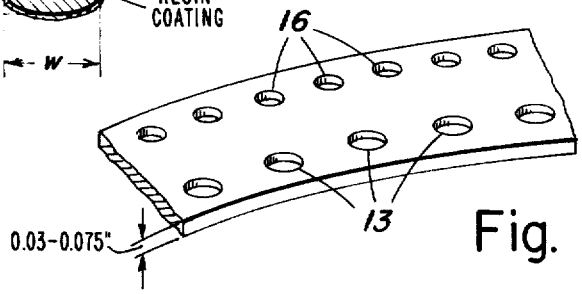
Fig. 4.
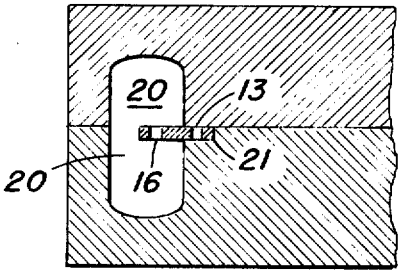
Fig. 7.
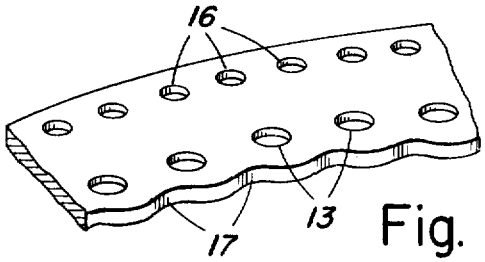
Fig. 5.
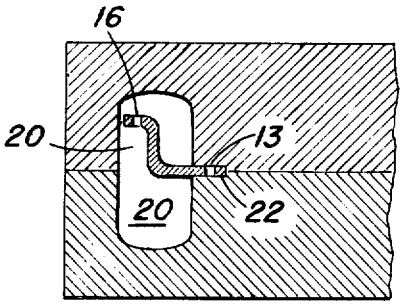
Fig. 8.
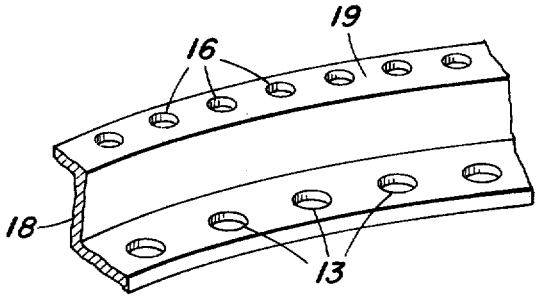
Fig. 6.

LOW DENSITY CAST RACQUET

BACKGROUND OF INVENTION

Tennis racquets have, for many years, been constructed of wood and in fact is still being used in the construction of some racquets. However, a wooden racque has certain inherent limitations, particularly as regards torsional and bending rigidity, it being generally recognized that these two parameters are mutually dependent in the sense that a wooden racquet designed to have a particular rigidity will have a built-in bending rigidity which may or may not be desirable from the standpoint of optimum racquet strength, flexibility, weight and other factors important to good racquet design.

The idea of forming a racquet of metal so as to overcome some of the deficiencies of wooden racquets is not new. French Pat. No. 800,262 (1936) discloses a metal tennis racquet comprising an alloy of aluminum and magnesium; and formed by casting the racquet in a mould followed by a thermal treatment to give suitable elasticity and resilience. In casting the head-portion of the racquet removable core pieces are assembled in the mould to form apertures in the head-portion for stringing the racquet. U.S. Pat. No. 3,702,189 Galich discloses a one-piece metal tennis racquet formed by casting an aluminum or magnesium alloy in a permanent mould. Stringing apertures are cast in the head-portion or frame and in addition an elongated annular groove is formed in the outer face of the frame for recessing the racquet string. The aforesaid annular groove is alleged to serve both as a means for weight and balance control as well as protective means for shielding the racquet string from abrasion. U.S. Pat. No. 3,702,701 Vaughn et al. discloses a tennis racquet frame formed of opposed, extruded aluminum, tubular sections joined by an integral metal web-portion having stringing apertures therein; and a strip of nylon is assembled on the web-portion to provide grommets for the stringing apertures in the metal web so as to reduce string abrasion. U.S. Pat. No. 3,664,669 Lantem et al. discloses another form of extruded aluminum tennis racquet the head-portion or frame of which comprises a hollow extrusion having a central wall separating the outer wall from a pair of flanges constituting the inner wall of the frame, the flanges being arranged to provide holding means for a plurality of individual, plastic, string-supporting elements designed to provide a relatively large gripping surface, i.e. large radii about which to bend the string so as to eliminate string breakage.

One of the major advantages of forming a racquet frame by casting, as against forming a frame by extrusion, is the freedom to vary the cross section of a cast frame place to place. On the other hand, a die cast metal frame will, in general, have less strength than an extruded frame, and more importantly, a die cast frame is generally subject to localized metal porosity which, when present in the area of the stringing holes of a racquet frame will cause rupture or breakthrough under the high stresses to which a racquet is subjected.

Hence, despite the progress that has been made in the construction of light metal racquets, the problems of achieving optimum strength to weight ratios, optimum stiffness, both longitudinal and torsional, and minimizing the incidence of string breakage; together with the development of production techniques that will ensure low unit cost, have mitigated against substantial acceptance of metal racquets as heretofore designed.

SUMMARY OF INVENTION

In co-pending application Ser. No. 279,116 filed Aug. 9, 1972, and issued as U.S. Pat. No. 3,815,660 Applicant et al. disclose a die cast light metal tennis racquet comprising an integral handle and head-portion or frame with stringing means cast into the frame, the stringing means being in the form of a strip of metal arranged substantially perpendicular to the plane of the racquet strings and provided with individual string receiving eyelets or portions of a sinuous wire — projecting at substantially right angles from the strip of metal inwardly toward the center of the frame.

The present invention relates to an improved low density cast racquet which takes advantage of design flexibility made possible by casting, while ensuring adequate strength in the area of the stringing holes by incorporating a wrought metal stringing member within the cast frame. The term "wrought", as used herein has the meaning commonly recognized in the metallurgical art, namely a metal that has been cold or hot worked in the solid state using conventional metal working techniques such as strip or sheet rolling, extrusion or forging. The improved racquet of this invention thus combines longitudinal and torsional stiffness with optimum strength to weight ratio, eliminates frame rupture at the stringing holes, precludes string breakage, and can be produced at relatively low cost per unit. Another attribute is color — the racquet of this invention being coated with various colored resins which not only enhance the appearance of the racquet but contribute to long string life.

In brief, the one-piece racquet of this invention comprises a head or frame, a handle and stringing means integrated in a one-piece construction by a single cast operation. The racquet head-portion or frame and the handle are formed of a material having a density below about 3.0 gm/cc as for example a light metal such as a magnesium or aluminum alloy or a suitable plastic such as a fiber reinforced plastic, said low density materials having a yield strength in the range of from 23,000 to 40,000 psi; while the stringing means, which is cast in the head portion of the frame in the manner hereinafter described, comprises a wrought metal insert, the outer portion of which, i.e. that portion of which is cast into the head-portion of the racquet, being provided with bonding means, and its inner portion, i.e. that portion which extends inwardly into the stringing plane of the racquet, being provided with circumferentially spaced apertures for receiving the racquet string. This wrought metal insert is preferably a high quality wrought light-weight metal, as for example wrought aluminum or wrought magnesium alloy, having a strength in excess of 40,000 psi and preferably about 70,000 psi. As such, it serves a double purpose, namely, to provide simple, inexpensive stringing means for the racquet head, and to reinforce the cast head-portion of the racquet. The cast racquet, and in particular the head portion, is provided with a finish coating of resin which is preferably colored to enhance the appearance of the racquet; and which when applied has been found to coat the edges of the stringing perforations in the wrought metal stringing means in a manner to preclude string abrasion or breakage.

Numerous other advantages of the invention will become apparent from the following description when read in conjunction with the accompanying drawings.

DESCRIPTION OF DRAWING

FIG. 1 is a plan view of the improved cast racquet of this invention as embodied in a tennis racquet.

FIG. 2 is an enlarged cross-sectional view of the head-portion of the racquet on line 2—2 of FIG. 1.

FIG. 3 is a perspective view of the wrought metal insert which serves to reinforce the head-portion of the racquet and as stringing means therefor.

FIG. 4 is an enlarged perspective view of the fragmentary portion of the wrought metal insert of FIG. 3.

FIG. 5 is an enlarged perspective view of a fragmentary portion of a modification of the wrought metal insert of FIG. 3.

FIG. 6 is an enlarged perspective view of the fragmentary portion of a further modification of the wrought metal insert.

FIG. 7 is a schematic cross sectional view of a two-piece die set for forming the head-portion of the racquet showing the recessed ledge on which the wrought metal insert is supported.

FIG. 8 is a modification of a two-piece die set of FIG. 7 showing a recessed ledge on each die part for accommodating the wrought metal insert.

FIG. 9 is an enlarged cross-sectional view of a modification of the head-portion of the racquet.

PREFERRED EMBODIMENT OF INVENTION

In its broadest aspects the invention relates to one-piece cast racquets as for example, tennis, squash or badminton racquets, but for purposes of illustration the embodiment disclosed and described herein is a tennis racquet having structural features qualifying it for the most rigorous professional use.

Referring to the drawings and more particularly to FIG. 1, the racquet is shown as comprising a head-portion or frame 10, having stringing means in the form of a wrought metal insert 11, and integrally joined to a handle 12, the entire assembly being formed in a single cast operation as hereinafter described.

In the embodiment of the invention as shown in FIG. 2, the head-portion or frame 10 is of substantially rectangular cross section and the height $h$ of the frame is greater than its width $w$, the value of $h$ for tennis racquets cast according to the method of the instant invention being from 0.375 to 0.750 inches and the width $w$ from 0.188 to 0.375 inches and preferably about 0.55 and 0.25 inches, respectively. While a frame of this cross section is especially desirable from the standpoint of simplicity of casting, the invention also contemplates racquet frames of other cross sections and in particular, a frame of I-beam cross section as disclosed in FIG. 9. This configuration approaches the ideal distribution of material for achieving optimum stiffness albeit requiring the use of somewhat more complicated and expensive die sets.

For purposes of illustration the low density material used in casting the one-piece racquet of this invention is a magnesium metal alloy having a yield strength of at least about 23,000 psi to as high as 40,000 psi. In this connection, it should be stressed that because of its low density, i.e. about 1.8 grams/cc, magnesium alloy is preferred to an aluminum alloy which has a density of about 2.7 gram/cc, or steel having a density as high as 7.5 grams/cc. Other low density materials which have sufficiently high ultimate strength for use in quality racquets are contemplated within the scope of this invention and include a fiber reinforced polycarbonate plastic material having a yield strength of about 23,000 psi and a density of about 1.5 grams/cc.

However, despite the high yield strength of these low density materials, magnesium and aluminum alloys and plastic materials of the type identified above may not always have the required longitudinal and/or torsional strength required of a quality racquet. It has now been discovered, however, that an optimum design may be effected by bonding a metal of high strength in the cast racquet frame. The suitable metals for this purpose are wrought aluminum or magnesium alloys or ferrous materials having a strength of the order of 70,000 psi. It was also found that the wrought aluminum or magnesium alloys or ferrous materials may be in the form of a relatively thin strip of metal shaped to conform to the shape of the head-portion of the racquet (see FIG. 3). A wrought metal insert may be formed as a simple extrusion; or may be stamped from flat sheet and used as is, as illustrated in FIGS. 3, 4 and 5, or cold-formed from strip into flat or non-flat configuration as shown in FIG. 6. As bonded in the cast racquet frame the wrought metal insert serves both to reinforce the frame and also as stringing means for stringing the racquet. In this connection, the wrought metal insert is provided with a plurality of apertures 13 suitably spaced around the inner edge 14 of the insert, see especially FIG. 4, the insert being bonded in the die-cast frame in a manner such that the inner edge 14 of the insert extends inwardly beyond the inner wall 15 of the racquet frame as shown especially well in FIG. 2. Consistent with the objects of the invention it was found that the thickness of the wrought metal insert may vary from 0.03 to 0.075 inches and that as a consequence the stringing apertures 13 may be formed by a relatively inexpensive punching operation in contrast to more expensive drilling operations. These apertures may be formed before or after casting the racquet head. Other factors regarding the wrought metal insert are its width, which may vary from 0.25 to 0.60 inches and in the preferred embodiment is about three-eighths inches; and the extent to which the insert is embedded in the racquet head. For a head-portion or frame having a width $w$ of about 0.25 inches the embedded or bonded portion of the wrought metal insert should be about 0.18 inches. It will be appreciated, however, that this is not a critical limitation and may vary depending upon frame thickness.

In addition to the stringing apertures 13 the wrought metal insert 11 is provided with bonding means by which the insert is locked securely in the cast head-portion of the racquet. Reference to FIG. 4 illustrates bonding means in the form of a plurality of apertures 16 punched or otherwise formed in the outer edge of the insert. The spacing of these apertures corresponds preferably, though not necessarily, to the spacing of the stringing apertures 13 and when filled with the molten low density metal or plastic during casting of the head-portion of the racquet firmly lock or bond the wrought metal insert therein. Other locking configurations may be, for example, knurling or ridges on the surface of the insert which will effectively bond the insert to the cast material.

While the wrought metal insert of FIG. 4 is of relatively simple and inexpensive construction the invention contemplates inserts of other forms as shown in FIGS. 5 and 6, respectively, which however are not exhaustive but merely illustrative of modifications of the insert of FIG. 4. The wrought metal insert of FIG. 5 is similar in substantially all respects to that shown in FIG. 4 except that its inner edge 14 is scalloped as indicated at 17. This construction contributes two advantages, namely, a reduction in weight and ease in bending the wrought metal strip to conform to the shape of the racquet head. The former factor is an important consideration in the design of racquets of different weights. Quality racquets usually fall within a rather limited weight range of from about 12 ¼ ounces to 14 ¼ ounces and many factors contribute to this weight range including the density of the material used in forming the cast racquet, the size of the racquet head, the size of the racquet handle, the dimension and configuration of the wrought metal insert, the weight of the string and, in the embodiment of the instant invention, the weight of resin used to coat the racquet head. Possible measures for effecting variation in weight, while maintaining the center of gravity substantially unchanged include selection of a low density material, i.e. one having a density within the range from 1.5 to 3.0 grams/cc, controlling die blow by shimming the die sets, controlling the thickness of the resin coating and similar considerations.

A further modification of the wrought metal stringing means or insert is shown in FIG. 6 wherein the portion 18 of the insert that is bonded in the racquet frame is substantially Z-shaped in cross section, its upper lip or rim 19 being provided with bonding apertures 16. This modification locates high strength wrought metal distant from the stringing plane thereby enhancing frame stiffness and serving a parallel function to that of the I-beam construction disclosed in FIG. 9.

While the wrought metal inserts are shown as comprising a single member, each may comprise several separate segments, as indicated by dotted lines in FIG. 3, which, when assembled and die cast in the frame will be so integrated as to have use characteristics comparable to a single member.

A further modification of the stringing means contemplated within the scope of the invention is one wherein the inner edge of the wrought metal ring comprises successive off-set portions alternately above and below, respectively, the plane of the ring each off-set portion having a stringing aperture therein whereby the racquet strings are disposed to lie in a single plane across the entire string surface of the racquet head.

An additional feature of the invention is the finish of the racquet. This is accomplished by first sand blasting or otherwise removing flash from the casting and then applying, electrostatically, a resin coating which may vary in thickness from 0.003 to 0.020 inches. The resin may comprise epoxy, nylon, vinyl and the like, and may be of different colors to enhance the appearance of the racquet. The resin coating is also functional in that it provides protection against corrosion and also grommeting of the stringing apertures in the wrought metal insert whereby, despite the relatively small radii about which the string is bent, the string has been found to withstand abrasion or breakage when tested for substantial number of hits - which is a clear functional requirement for high quality racquets and which many existing commercial metal racquets have failed to satisfy.

While a resin provides an ideal coating it is within the purview of the invention to use a suitable paint, lacquer or the like.

A one-piece cast tennis racquet having a frame of substantially rectangular cross section, as shown in FIG. 2, is made in a two-piece die set. FIG. 7 is a schematic fragmentary portion, in vertical section, of that portion of the die set in which the head or frame of the racquet is formed. A die cavity 20 is provided in each of the two complementary dies, each cavity being substantially identical and conforming in cross section to the cross section of the racquet frame. FIG. 7 shows one method for assembling the wrought metal insert in the die. In this embodiment the die cavity in one of the pair of dies is deeper than that in the other by one-half the thickness of the insert, the inner rim of this deeper die cavity being provided with a recessed step 21 substantially equal in depth to the thickness of the wrought metal insert on which the inner edge of the wrought metal insert is seated — with its opposite or outer edge projecting into the die cavity. Upon assembling the two dies together and forcing light metal or plastic material into the die cavities, the racquet head is formed and simultaneously the wrought metal insert is bonded therein.

A modification of the two piece set is shown in FIG. 8 wherein the wrought metal insert is located in dies each formed with a recess step 22 substantially equal in depth to one-half the thickness of the wrought metal insert. Thus, when bonded in the frame the stringing apertures of the insert are substantially in the plane of the racquet strings.

While this invention has been described and illustrated as related to a die cast light metal tennis racquet the invention is not limited thereto and other variations and modifications may be employed and are contemplated within the scope of the following claims.

What is claimed is:

1. A cast racquet comprising an integral solid head-portion enclosing a stringing area, a handle, and stringing means conforming to the shape of said head-portion, said head-portion and handle formed of low density castable material, said stringing means consisting of a separate, one-piece, wrought sheet metal member Z-shaped in cross section, said Z-shaped wrought metal member having an outer portion comprising an implant encapsulated by said cast head-portion, and a perforated inner stringing portion extending inwardly beyond the inner peripheral wall of said head-portion and in the plane of the stringing area of said cast head-portion, the said outer encapsulated portion of said Z-shaped member being displaced vertically from its inner perforated stringing portion the perforations of which constitute apertures for receiving the strings of said racquet.

2. A cast racquet according to claim 1 wherein said castable material has a density not above about 3.0 grams per cubic centimeter.

3. A cast racquet according to claim 1 wherein said low density castable material is a magnesium alloy.

4. A cast racquet according to claim 1 wherein said low density castable material is an aluminum alloy.

5. A cast racquet according to claim 1 wherein said low density castable material is a plastic having a yield strength of at least about 23,000 psi.

6. A cast racquet according to claim 1 wherein said one piece Z-shaped wrought sheet metal stringing member has a strength of at least about 40,000 psi.

7. A cast racquet according to claim 6 wherein said one piece wrought sheet metal stringing member comprises Z-shaped aluminum alloy.

8. A cast racquet according to claim 1 wherein the said encapsulated outer portion of said one piece Z-shaped sheet metal stringing member is provided with bonding means constructed and arranged to bond said wrought metal member in said cast head-portion..

9. A cast racquet according to claim 1 wherein the thickness of said one piece Z-shaped wrought sheet metal stringing member is in the range of from 0.03 to 0.075 inches.

10. A cast racquet according to claim 1 wherein the head-portion of said racquet and the apertured inner portion of said Z-shaped stringing means are provided with a protective coating.

11. A cast racquet according to claim 10 wherein the protective coating is a colored resin.

* * * * *